US012486669B2

(12) United States Patent
Grønbæk

(10) Patent No.: US 12,486,669 B2
(45) Date of Patent: Dec. 2, 2025

(54) FLASHING DEVICE AND A METHOD OF MOUNTING A FLASHING DEVICE AT A ROOF WINDOW

(71) Applicant: VKR Holding A/S, Hørsholm (DK)

(72) Inventor: Kristian Strand Grønbæk, Gedved (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 18/849,489

(22) PCT Filed: Mar. 31, 2023

(86) PCT No.: PCT/DK2023/050086
§ 371 (c)(1),
(2) Date: Sep. 21, 2024

(87) PCT Pub. No.: WO2023/186249
PCT Pub. Date: Oct. 5, 2023

(65) Prior Publication Data

US 2025/0109593 A1 Apr. 3, 2025

(30) Foreign Application Priority Data

Mar. 31, 2022 (DK) ..... PA 2022 70172

(51) Int. Cl.
*E04D 13/147* (2006.01)
*E04D 13/03* (2006.01)

(52) U.S. Cl.
CPC ..... *E04D 13/1475* (2013.01); *E04D 13/031* (2013.01)

(58) Field of Classification Search
CPC ..... E04D 13/031; E04D 13/1415; E04D 13/1475; E04D 2013/045
(Continued)

(56) References Cited

U.S. PATENT DOCUMENTS 7,059,086 B2 * 6/2006 Edvardsen ..... E04D 13/1475 52/60
8,869,462 B2 * 10/2014 Baron ..... E04D 13/0459 52/60

(Continued)

FOREIGN PATENT DOCUMENTS

EP 1533436 A2 * 5/2005 ..... E04D 13/031
WO WO2004051026 6/2004
WO WO-2004051026 A1 * 6/2004 ..... E04D 13/02

OTHER PUBLICATIONS

International Search Report issued in connection with International Application No. PCT/DK2023/050086.

(Continued)

*Primary Examiner* — Christine T Cajilig
(74) *Attorney, Agent, or Firm* — Merek, Blackmon & Voorhees, LLC

(57) ABSTRACT

A flashing device (1014) for a roof window (1) comprising a first flashing member (1015), a second flashing member (1016) and two sealing members (106) arranged at opposite ends of the flashing device. The first and second flashing members are interconnected in sliding engagement allowing the relative position between them to be adjusted during mounting. Each sealing member (106) includes a first sealing portion (1061) positioned substantially in parallel with an inward portion of the second flashing member and a second sealing portion (1062) positioned substantially in parallel with a downward portion of the second flashing member. The sealing member (106) further comprises at least one frame attachment portion configured for attachment of the sealing member to the frame of the roof window. A method of mounting a flashing device is also disclosed.

18 Claims, 8 Drawing Sheets

(58) Field of Classification Search
USPC ..... 52/60
See application file for complete search history.

(56) References Cited

U.S. PATENT DOCUMENTS

| | | | | |
|---|---|---|---|---|
| 10,988,932 | B2 * | 4/2021 | Allesen | E06B 7/2312 |
| 2004/0103592 | A1 * | 6/2004 | Edvardsen | E04D 13/04 52/58 |
| 2014/0318049 | A1 * | 10/2014 | Paquet | E06B 3/64 52/204.593 |
| 2020/0224422 | A1 * | 7/2020 | Allesen | E06B 7/2312 |

OTHER PUBLICATIONS

Written Opinion issued in connection with International Application No. PCT/DK2023/050086.
International Preliminary Report on Patentability issued in connection with International Application No. PCT/DK2023/050086.

* cited by examiner

FLASHING DEVICE AND A METHOD OF MOUNTING A FLASHING DEVICE AT A ROOF WINDOW

TECHNICAL FIELD

The present invention relates to a flashing device for a roof window comprising a frame and mounted in a roof structure, said flashing device comprising a first flashing member and a second flashing member both extending in a length direction, and two sealing members arranged at opposite ends of the flashing device seen in the length direction, where an upwards portion of the first flashing member and a downwards portion of the second flashing members are interconnected in sliding engagement allowing the relative position between the first and second flashing members to be adjusted during mounting of the flashing device, where the first flashing member further comprises a outward portion extending at an angle in relation to the upwards portion and being configured for extending over the roof structure away from the roof window, where the second flashing member further comprises an inward portion extending at an angle in relation to the downward portion and being configured for engagement with the frame of the roof window, and where each sealing member includes a first sealing portion and a second sealing portion, said first sealing portion being positioned substantially in parallel with the inward portion and said second sealing portion being positioned substantially in parallel with the downward portion. The invention further relates to a method of mounting a flashing device at a roof window.

BACKGROUND ART

When installing windows in a roof structure of a building it is necessary to make an opening in the roof structure and subsequently to re-establish the weather proofing of the building otherwise provided by the roof structure. For this purpose, the joint between the roof window and the roof structure is covered by a covering assembly including flashing and cladding members and devices. To achieve the best possible weather proofing it is essential that the covering assembly is mounted correctly and that it subsequently stays in place, even during heavy winds and when affect by big temperature variations. Moreover, it is important that the components of the covering assembly themselves remain water proof.

A flashing device of the type mentioned above comprising a sealing member is known from the applicant's prior patent application WO2004/051026A1 and has been in successful use for many years, but new types of roof windows and an increase in the use of roof window in roof with low pitches has prompted a desire for further development.

SUMMARY OF INVENTION

With this background, it is an object of the invention to provide an improved flashing device and a method for mounting a flashing device at a roof window.

This and further objects are achieved with a roof window of the kind mentioned in the introduction, which is furthermore characterised in that the sealing member comprises at least one frame attachment portion configured for attachment of the sealing member to the frame of the roof window. By the provision of the frame attachment portion, the sealing member not only contributes to weather-proofing the flashing device itself, as was the case in WO2004/051026A1, but also contributes to establishing a connection between the flashing device and frame of the roof window. Thereby the number of parts needed for the installation of the roof window and consequently the number of joints can potentially be reduced. Furthermore, as the connection has a built-in sealing function due to being incorporated in the sealing member, the need for subsequently sealing joints using for example a silicone-based joint filler, as is commonly seen with many prior art roof windows, may be reduced.

A flashing device of this type is particularly well suited for use at the bottom of a roof window mounted in an inclined roof structure, where the sliding engagement between the flashing members allows an adaptation to different angles of inclination of the roof structure. In the following reference will therefore be made to the flashing device being mounted at a bottom frame member of the frame of the roof window. It is, however, to be understood that the invention is not limited to this use.

Since the first sealing portion is positioned substantially in parallel with the inward portion and the second sealing portion is positioned substantially in parallel with the downward portion, the sealing member is substantially L-shaped.

The sealing member is preferably made from a resilient material, preferably an elastomer, such as ethylene propylene diene monomer (EDPM).

The at least one frame attachment portion may comprise a flange extending from the first sealing portion and being configured for sliding engagement with a groove in the frame. When the flashing device is mounted at the roof window, said flange is brought into a groove in the frame as the flashing device is displaced relative to the frame. The displacement may be substantially perpendicular to the frame plane defined by the frame members of the frame, but it is presently considered advantageous to bring the flashing device into contact with the frame by displacing it in a direction parallel to the frame plane, i.e. in a direction substantially perpendicular to the upwards and downwards portions and to the length direction of the flashing device. This may for example allow the flashing device to be arranged underneath another part of the roof window or to be slid into engagement with a flashing member or a cover member. If the flashing device is mounted at a bottom frame member with the length direction of the flashing device extending in parallel to the length direction of the bottom frame member, the displacement is preferably perpendicular to the length direction of the bottom frame member.

In one embodiment, the flange comprises a first flange leg extending from the first sealing portion away from the second sealing portion and a second flange leg extending substantially perpendicular to the first flange leg and substantially in parallel with the first sealing portion, the flange thus having an L-shape. This will for example allow the second flange leg to be arranged in a groove extending substantially parallel to the first sealing portion at a distance from it, and/or a fixation of the sealing member in two directions.

It is presently considered advantageous that the flange has a length direction extending substantially perpendicular to the length direction of the flashing device and that the flashing device is mounted by displacement in a direction substantially parallel to the inward portion and perpendicular to the length direction.

The flange may be brought into engagement with a groove in an interface unit of/on the frame, said interface unit for example including an extruded profile made from a metal, such as aluminium, or a dimensionally stable polymer, such as a thermoplastic elastomer, for example polyvinylchloride or polypropylene, possibly reinforced by fibres, such as glass fibres.

Alternatively, or in addition, the at least one frame attachment portion may comprise a fastener guiding section configured for guiding a fastener used for securing the sealing member to the frame. During mounting of the flashing device, a fastener can be inserted in the fastener guiding section and driven into the frame, the fastener guiding section ensuring that the fastener penetrates into the frame or an interface unit thereon at the correct position and at the same time sealing the joint between the fastener and the frame. In one embodiment, the fastener guiding section extends substantially in parallel with the first sealing portion and substantially perpendicular to the second sealing portion, thus guiding the fastener in a direction, which is substantially parallel to the frame plane and perpendicular to the frame member at which the flashing device is mounted. Specifically, it is presently considered advantageous that the fastener guiding section extends from an opening in the second sealing portion and through the first sealing portion. As the sealing members are located at the ends of the flashing device in the length direction thereof, the fastener may be driven into the ends of the frame members extending perpendicular to frame member along which the flashing device extends in the mounted state, i.e. the side frame members when the flashing device is used at the bottom frame member of a roof window. The fasteners need not be driven into the actual frame members. As mentioned above, it is also possible for the frame to include an interface unit for engagement with other parts of the roof window and such an interface unit may be used for receiving the fasteners.

To further facilitate the joining of the different parts of the roof window, the second flashing member may comprise a hole positioned in continuation of the fastener guiding section, such that a fastener guided by the fastener guiding section projects through said hole.

The sealing member may further comprise a support projection supporting the inward portion of the second flashing member and forming a sealing connection therewith.

Still further the sealing member may comprise one or more of the following:

- One or more guiding surfaces on the second sealing portion for engagement with an extended section of the second flashing member,
- An opening in the second sealing portion accommodating an extended section of the second flashing member, and
- Ribs on the first and/or the second sealing portion.

A second aspect of the invention relates to a method of mounting a flashing device at a roof window comprising a frame and mounted in a roof structure, comprising the following steps:

A) providing a flashing device according to the first aspect of the invention,

B) arranging the flashing device on the roof structure and at an outer side of the frame of the roof window facing away from a frame opening defined by the frame, C) connecting the sealing member to the frame using at least one frame attachment portion.

It is noted that the reference to the flashing device does not have to be in direct engagement with an outer side of the frame of the roof window. It may also be in engagement with insulating material, such as an insulating frame arrange around the frame, or with other items related to the installation or operation of the roof window, such as a motor enclosure.

Embodiments and advantages described with reference to one aspect of the invention also apply to the other aspects of the invention and vice versa.

BRIEF DESCRIPTION OF DRAWINGS

In the following description embodiments of the invention will be described with reference to the schematic drawings, in which.

DESCRIPTION OF EMBODIMENTS

Figure 1:
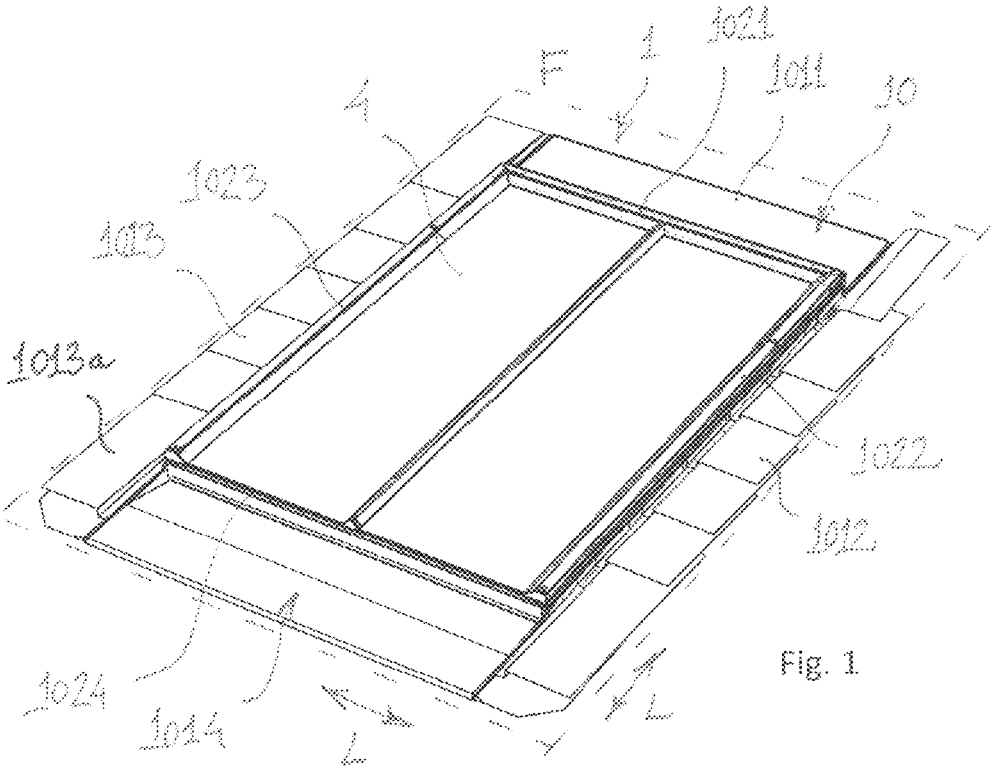
FIG. 1 is a perspective view of a roof window with a covering assembly.

Referring initially to FIG. 1, a roof window 1 is shown with a covering assembly 10, where the right-hand side of the top flashing member 1011 is shown in a state of delivery, before adaptation to the shape of a roofing material used alongside the roof window. The roof window 1 is shown in an inclined position as it is intended for being mounted in an inclined roof structure.

In addition to the top flashing member 1011, the covering assembly comprises a plurality of side flashing members 1012, 1013, a bottom flashing device 1014 and a plurality of cladding members 1021, 1022, 1023, 1024 each covering a part of the sash carrying the pane element 4.

The roof window 1 comprises a frame (not visible in FIG. 1), and the top flashing member 1011, the side flashing members 1012, 1013, and the bottom flashing device 1014 extend in a respective length direction L along top, side and frame members, respectively. Together the frame members define a frame opening covered by the pane element 4 and a frame plane F.

Figure 2:
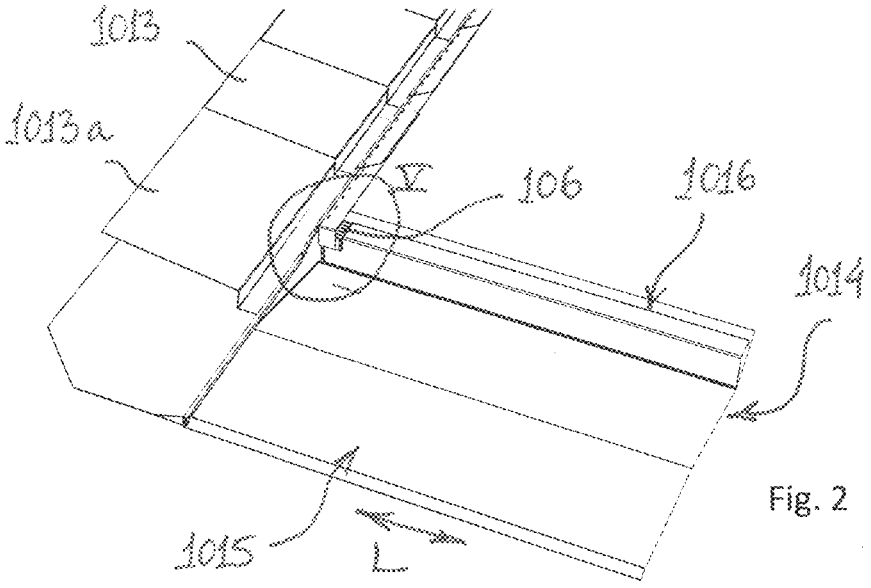
FIG. 2 is a perspective cross-sectional view showing the lower left-hand corner of flashing members and flashing device on the roof window in FIG. 1, FIGS. 3 and 4 are a perspective cross-sectional views showing the end sections of the flashing members of the flashing device in FIG. 1 and FIG. 2, FIGS. 5 and 6 are a perspective cross-sectional views showing the detail marked V in FIG. 2 from different angles.

The bottom flashing device 1014 is shown in more detail in FIG. 2 corresponding to the lower left-hand side of FIG. 1, but showing only the flashing members and the flashing device. The bottom flashing device comprises a first flashing member 1015 and a second flashing member 1016 both extending in a length direction L of the flashing device and being interconnected in sliding engagement allowing the relative position between the first and second flashing members to be adjusted in a height direction perpendicular to the frame plane F during mounting of the flashing device.

Figure 3:
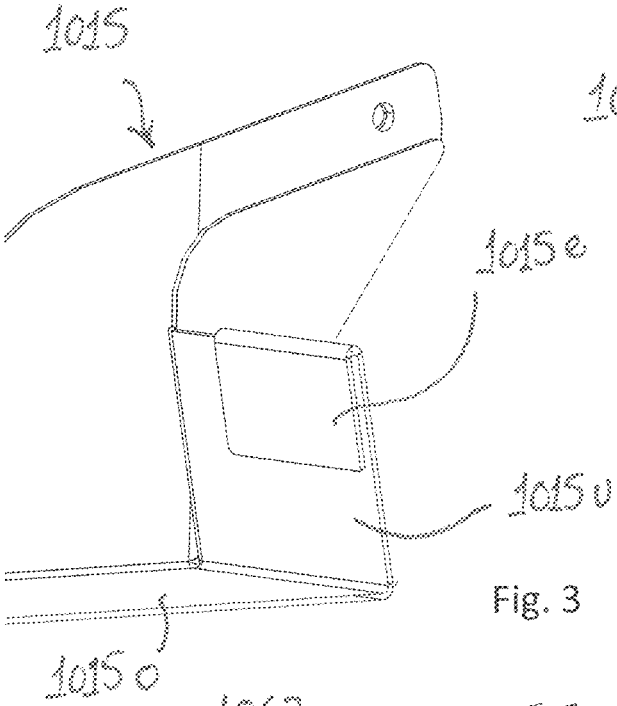
Figure 4:
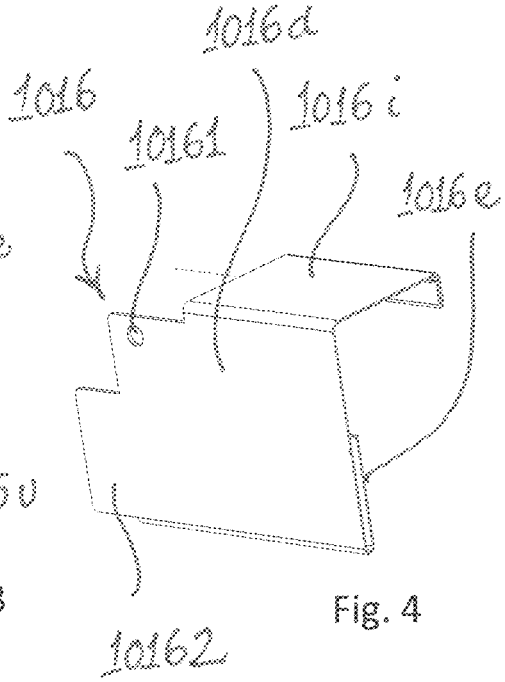

End sections of the first and second flashing members 1015, 1016 are shown in FIG. 3-4.

The first flashing member 1015 comprises an outward portion 10150 being configured for extending over the roof structure away from the roof window and an upwards portion 1015*u* extending at an angle in relation to the outward portion and being configured for extending up along and outer side of the frame of the roof window. In the bottom flashing device the upwards portion 1015*u* is connected to a downwards portion 1016*d* of the second flashing members 1016 configured for extending down along the outer side of the frame of the roof window, and the second flashing member further comprises an inward portion 1016*i* extending at an angle in relation to the downward portion and being configured for engagement with an exterior side of the frame of the roof window. In this embodiment the upwards portion 1015*u* and the downwards portion 1016*d* both have bent edges 1015*e*, 1016*e* embracing each other in the mounted state as shown in FIG. 5 and FIG. 6 and allowing a telescopic mutual movement both in the length direction L and in a height direction perpendicular to the frame plane F.

Figure 5:
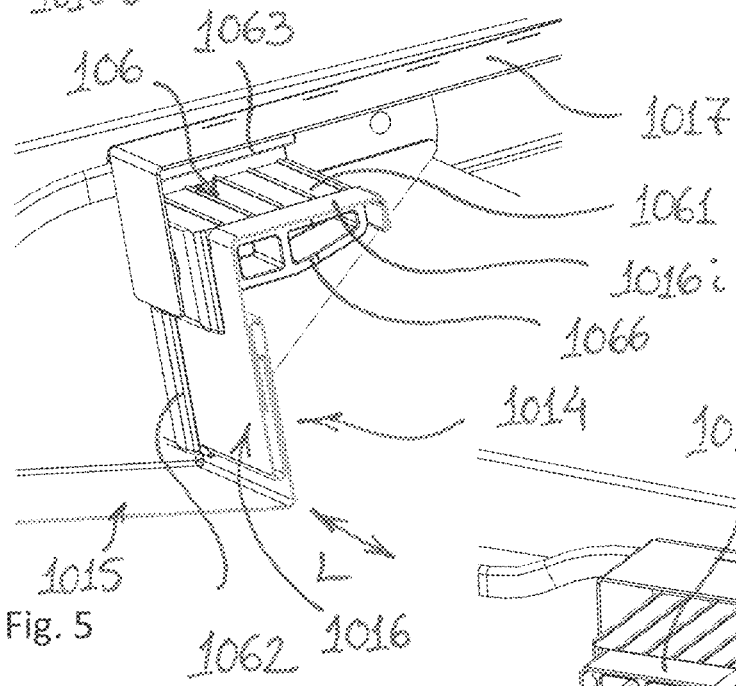
Figure 6:
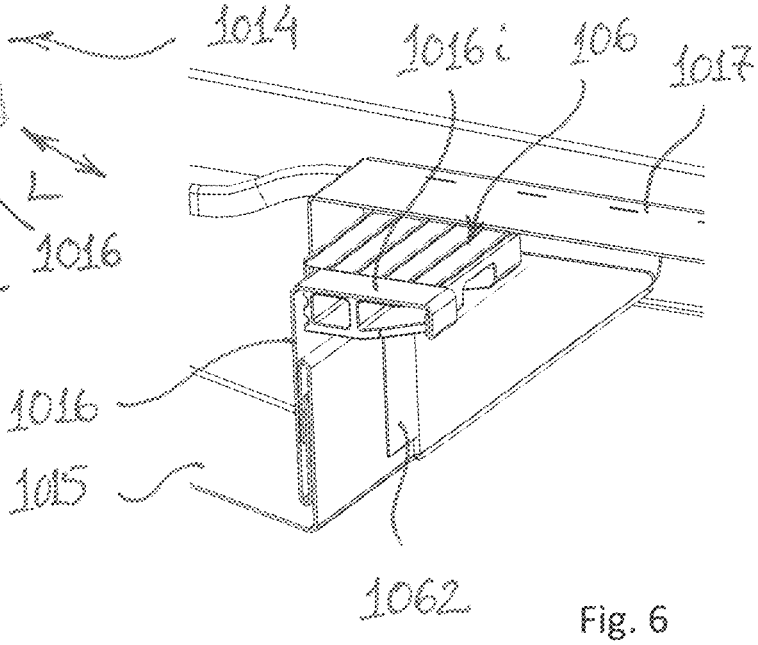

FIG. 5 and FIG. 6 also show that a sealing member 106 is arranged at the end of the flashing device and it is to be understood that a similar sealing member is found at the opposition end of the flashing device 1014.

Each sealing member 106 includes at least one first sealing portion 1061 positioned substantially in parallel with the inward portion 1016*i* and a second sealing portion 1062 positioned substantially in parallel with the downward portion 1016*d*, giving the sealing member an L-shape.

Figure 7:
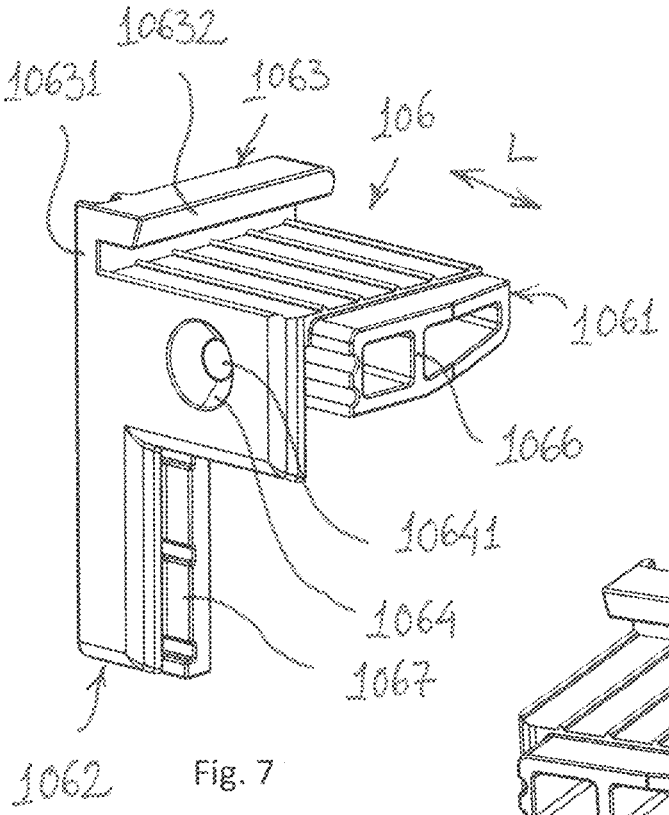
FIG. 7-9 show the sealing member used in the flashing device in FIG. 1 and FIG. 2 from different angles.
Figure 8:
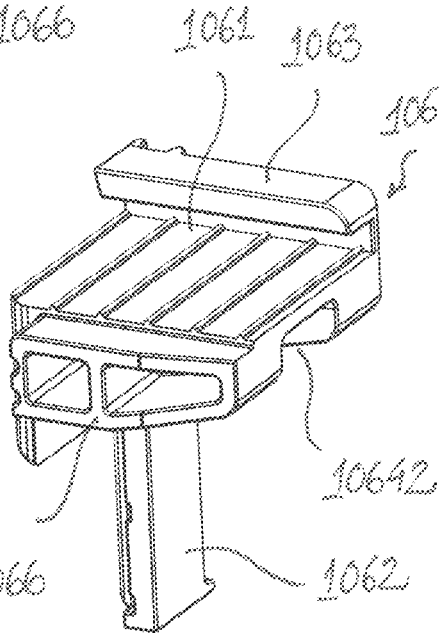
Figure 9:
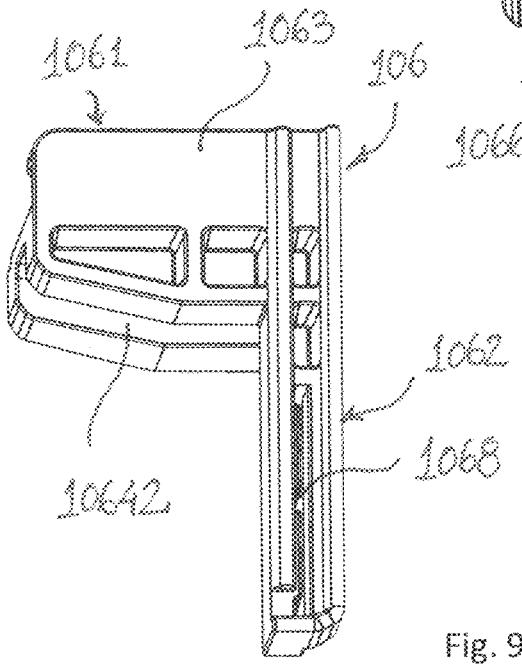

Turning now also to FIG. 7-9, showing the sealing member 106 from different angles, the sealing member further comprises two frame attachment portions 1063, 1064 configured for attachment of the sealing member to the frame of the roof window.

A first frame attachment portion in the form of a flange 1063 extends from the first sealing portion 1061 and comprises a first flange leg 10631 extending from the first sealing portion away from the second sealing portion 1062 and a second flange leg 10632 extending substantially perpendicular to the first flange leg and substantially in parallel with the first sealing portion. As may be seen in FIG. 5, the flange 1063 extends perpendicular to the length direction L of the flashing device 1014 in the mounted state and engages with a flange 1017 of lowermost side flashing member 1013*a*.

Figure 10:
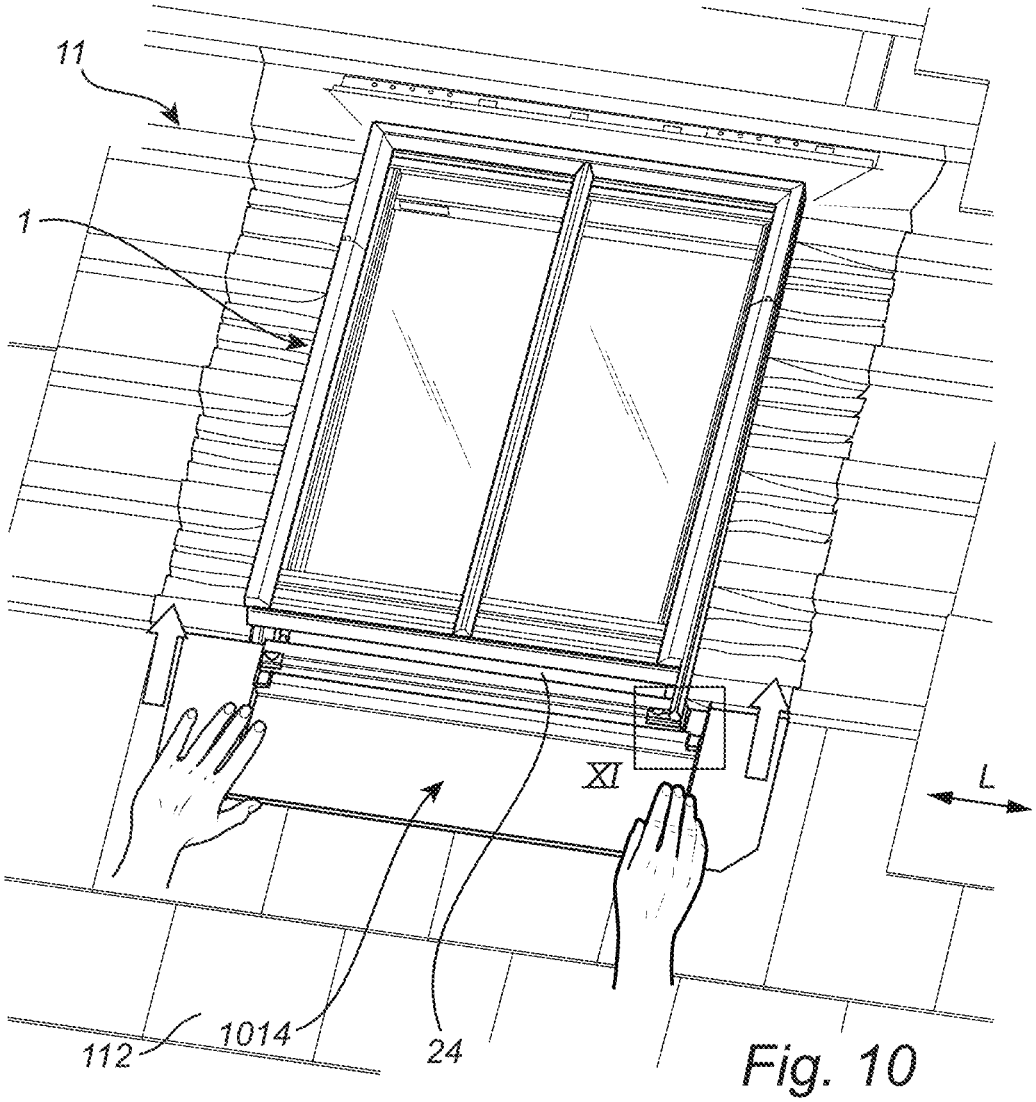
FIG. 10 is a perspective view showing the mounting of a bottom flashing member.

As shown in FIG. 10, where the roof window 1 is shown mounted in a roof structure 11 with a roofing material 112, the mounting of the covering assembly starts with the mounting of the bottom flashing device 1014 and it is displaced in a direction parallel to the frame plane F and perpendicular to the length direction L of the bottom frame member 24. As a result of this displacement, the first frame attachment portion 1063 comes into engagement with a side element 82 of an interface unit 8 as shown in FIG. 11, by the first flange leg 10631 sliding into a groove 85 in the side element 82.

Figure 11:
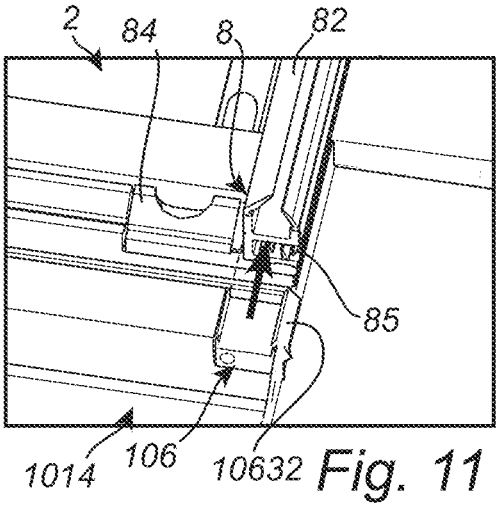
FIGS. 11 and 12 are perspective views of the detail marked XI in FIG. 10 at different stages during mounting of a bottom flashing member, FIG. 13-16 correspond to FIG. 3-6 only showing a different embodiment.
Figure 12:
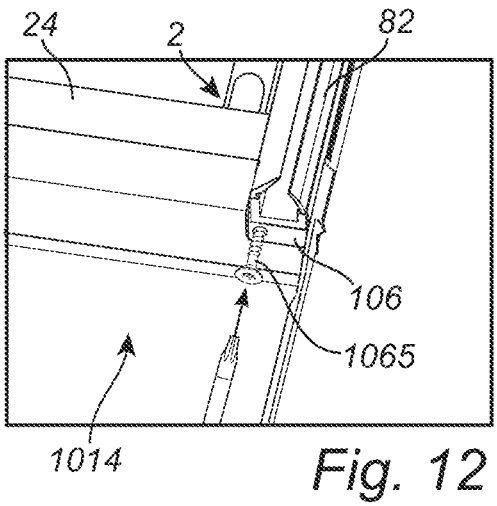
Figure 13:
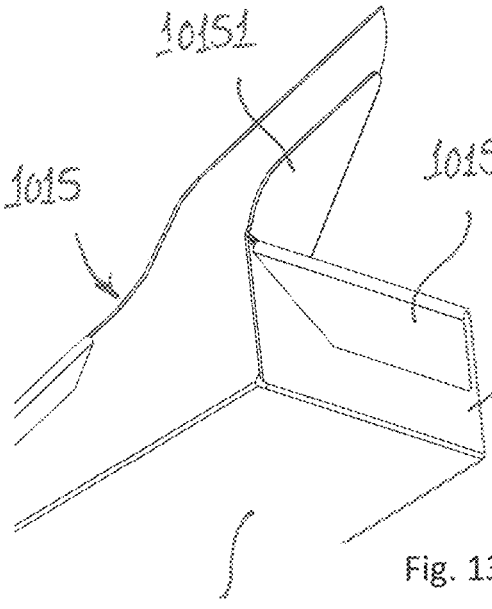
Figure 14:
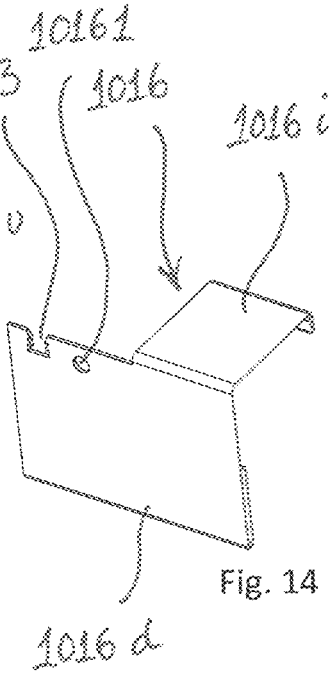
Figure 15:
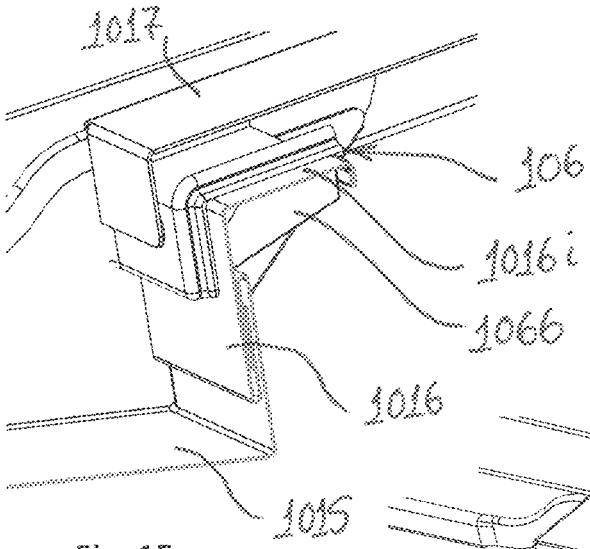
Figure 16:
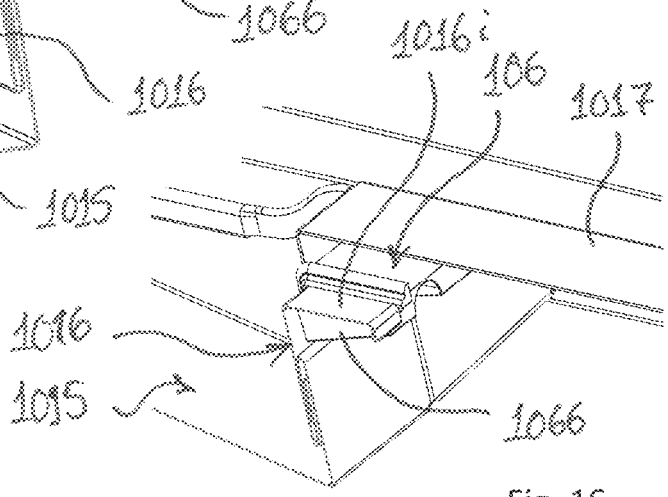
Figure 17:
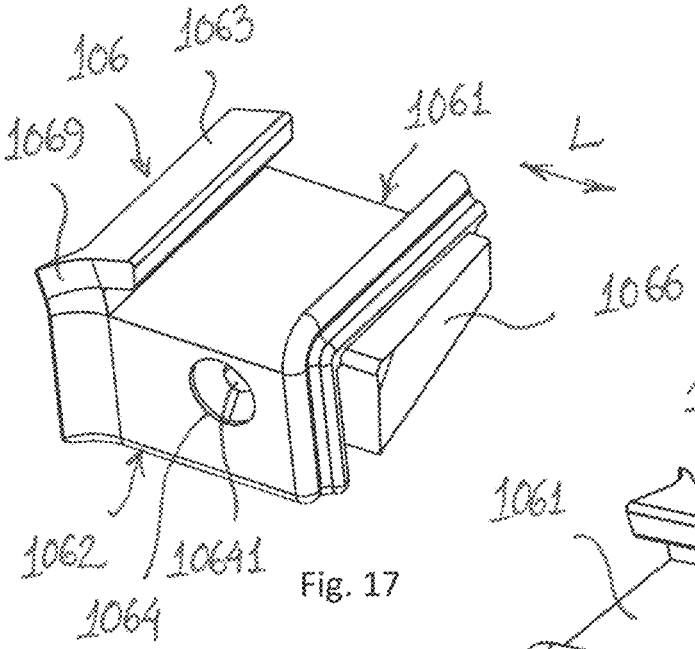
FIG. 17-20 show the sealing member used in FIG. 13-16 from different angles.
Figure 18:
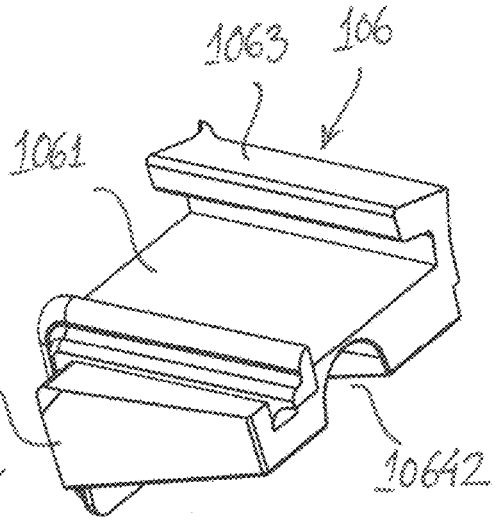
Figure 19:
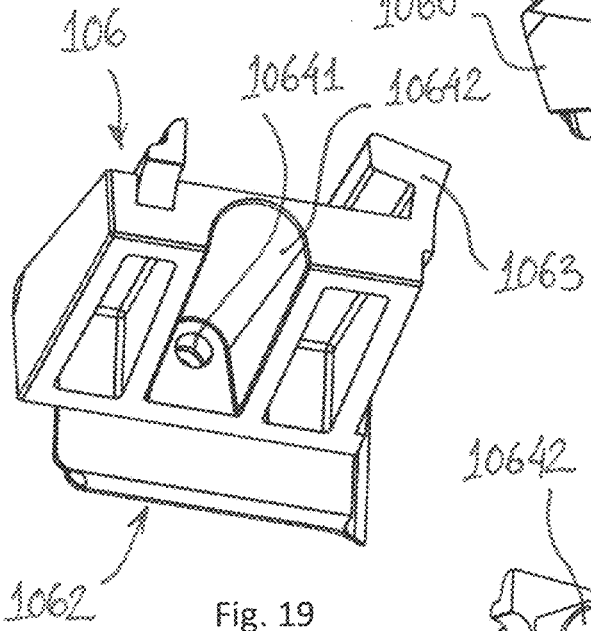
Figure 20:
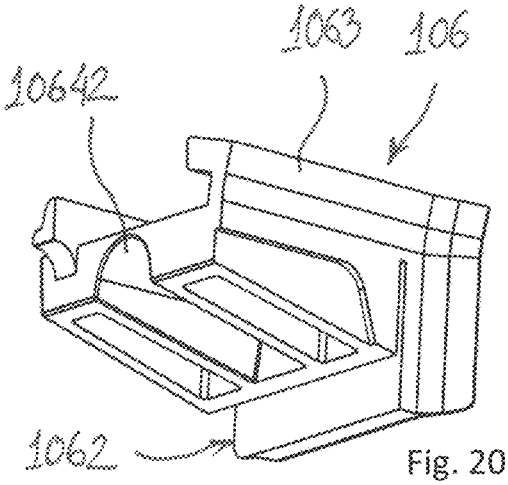
Figure 21:
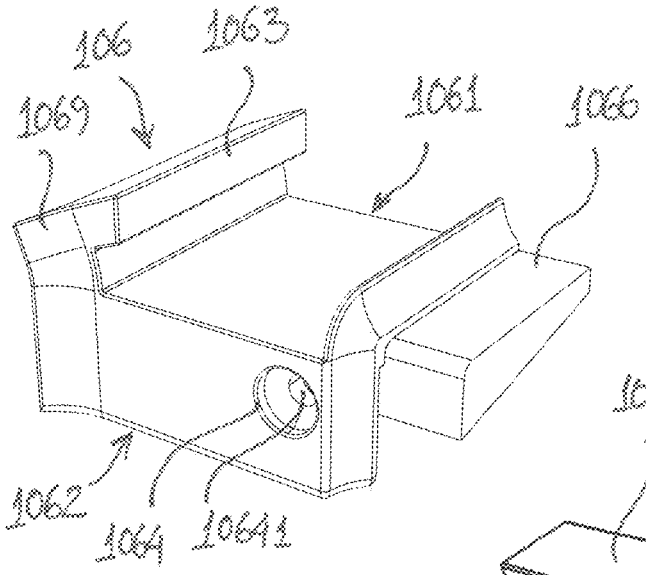
FIG. 21-24 show another embodiment of the sealing member from different angles.
Figure 22:
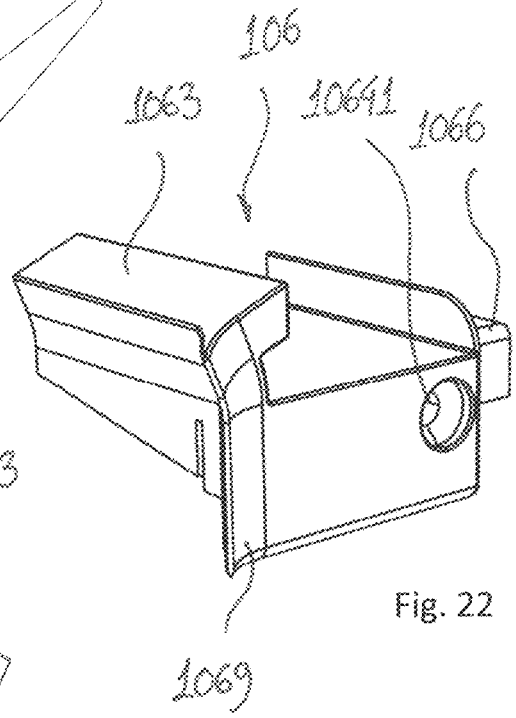
Figure 23:
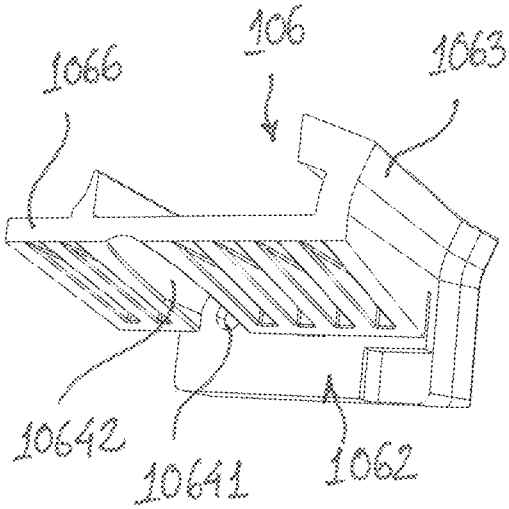
Figure 24:
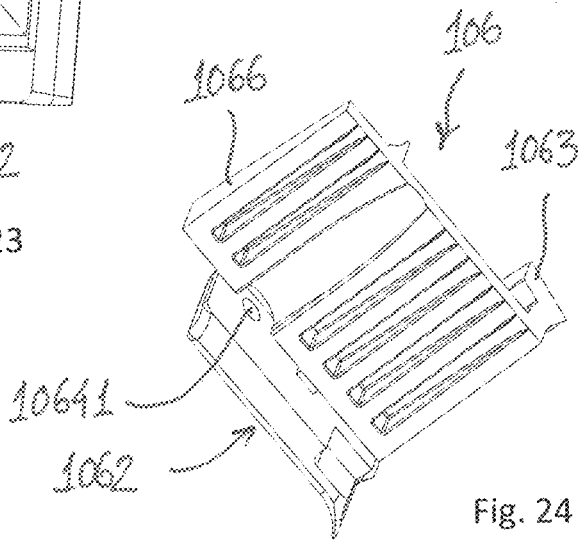

While FIG. 2-6 shown the left-hand side of the roof window as seen in FIG. 1, the FIGS. 11 and 12 show the right-hand side. It is to be understood that the two sides are identical, except for being mirror inverted and that the sealing member used at the right-hand side is also mirror inverted in relation to that shown in FIG. 7-9.

The second frame attachment portion in the form of a fastener guiding section 1064 is configured for guiding a fastener 1065 used for securing the sealing member to the frame as shown in FIG. 12. The fastener guiding section extends from an opening 10641 in the second sealing portion 1062 and through the first sealing portion 1061 in a direction substantially in parallel with the first sealing portion and substantially perpendicular to the second sealing portion. In the embodiment shown, the fastener 2065 is a screw, which is driven into a bottom element 84 of the interface unit 8, said bottom element being seen in FIG. 11, where the bottom flashing device is not yet in its mounted position.

As seen in FIG. 4, the second flashing member 1016 in this embodiment comprises a hole 10161 in the downwards portion 1016*d* and in the assembled state of the bottom flashing device 1014 shown in FIG. 1 and FIG. 2, this hole is positioned in continuation. When the fastener 1065 is inserted into the fastener guiding section it will project through said hole and the bottom flashing device will thus only be attached indirectly to the frame of the roof window via the connection to the sealing member attached thereto but also directly by the engagement with the fastener.

While the frame attachment portions 1063, 1064 have here been described as being attached to a side element 82 and a bottom element 84 of an interface unit, it is to be understood that such a unit need not be present and that the frame attachment portions may instead be used for attachment directly to a traditional frame member.

The sealing member 106 further comprises a support projection 1066 forming part of the first sealing portion 1061 and supporting and sealing against the inward portion 1016*i* as shown in FIG. 5.

The sealing member 106 further comprises guiding surfaces 1067 on the second sealing portion 1062 for engagement with an extended section 10162 of the second flashing element 1016 during assembly, and an opening 1068 in the second sealing portion accommodating the extended section in the assembled state.

In the embodiment shown, both the first sealing portion 1061 and the second sealing portion 1062 comprises ribs for preventing full surface contact with the second flashing member 1016.

An alternative embodiment of the sealing member 106 and the flashing device is shown in FIG. 13-21, where FIG. 13-16 correspond to FIGS. 3-6 and FIG. 17-20 show the sealing member from different angles.

The sealing member 106 in FIG. 13-21 differs from that described above in that second sealing portion is shorter and does neither extend into contact with second flashing member 1015 as shown in FIG. 6 nor comprises the opening 1068 for accommodating an extended section of the second flashing element. Instead that sealing member rides on the second flashing member 1016 engaging with a recess 10163 in the second flashing member.

The sealing member 106 comprises a sealing lip 1069 engaging with a part 10151 of the second flashing member 1015 projecting along a side member of the frame of the roof window. Such a lip may also be added to the sealing member in FIG. 7-9.

A further alternative embodiment of the sealing member 106 is shown in FIG. 21-24.

Figure 25:
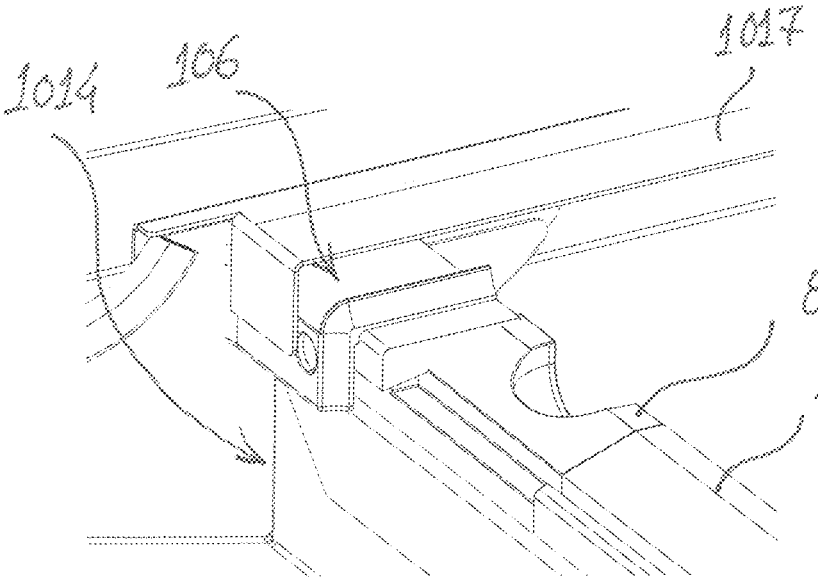
FIG. 25 is a perspective view of the sealing member in FIG. 21-24 in a mounted state.
Figure 26:
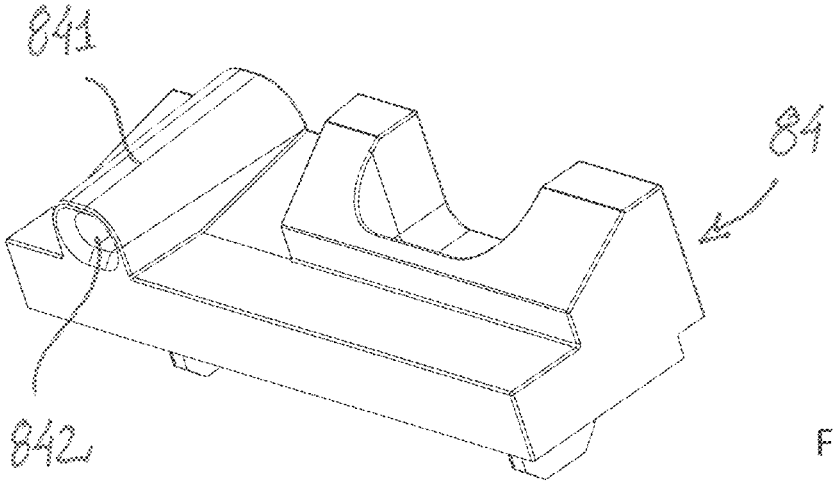
FIG. 26 is a perspective view of the bottom element of an interface unit used in FIG. 25.

The attachment of the flashing device and sealing member in FIG. 13-20 as well as the sealing member in FIG. 21-24 to the frame of the roof window happens in the same way as described above, and the bottom element 84 of the interface unit is seen in FIG. 25 and shown alone in FIG. 26. As may be seen in FIG. 26, the bottom element 84 comprises a fastener guiding section 841 with an opening 842. The fastener guiding section 841 fits into the recess 10642 in the bottom of the sealing member seen in FIGS. 8, 9, 18, 19, 20, 23 and 24 and the opening 842 aligns with the opening 10641 in the sealing member so that a fastener 1065 inserted into the fastener guiding section 1064 of the sealing member is received in the fastener guiding section 841 of the bottom element 84. In the embodiments in FIGS. 8, 9, 18, 19, 20, 23 and 24 the fastener guiding section 1064 of the sealing member is relatively short, but it is to be understood that it may be longer and that the fastener guiding section 841 in the bottom element will then be correspondingly shorter.

Figure 27:
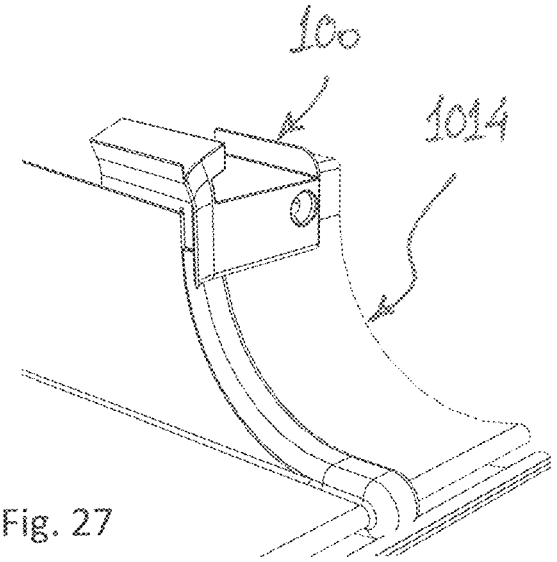
FIG. 27 is a perspective view of the sealing member in FIG. 13-20 used with a one-part bottom flashing member.
Figure 28:
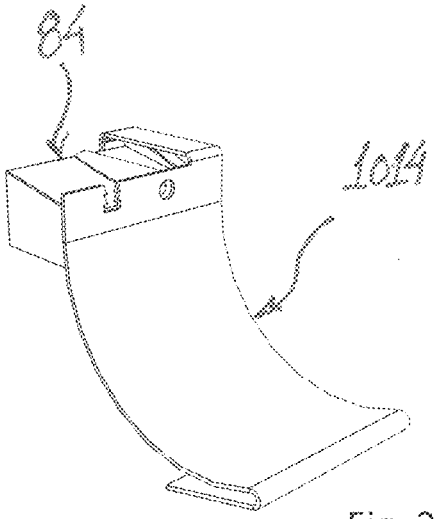
FIG. 28 is a perspective view of a bottom element of an interface unit and part of the bottom flashing member in FIG. 27.

As shown in FIG. 27-28 the sealing member 106 shown in FIG. 17-20 may also be used on a one-part bottom flashing member, not only on a two-part flashing device. This allows the use of the same sealing member on several different roof windows, and or in combination with several different covering assemblies 10 designed for example for different installation depths of the roof window in the roof structure.

Components of the roof window 1 and flashing device 1014 are easily disassembled and each component may in principle be reused, be recycled by appropriate environmentally responsible disposal means, or the material be recovered for other uses.

The invention claimed is:

1. A flashing device for a roof window comprising a frame and mounted in a roof structure, said flashing device comprising a first flashing member and a second flashing member both extending in a length direction of the flashing device, and two sealing members arranged at opposite ends of the flashing device seen in the length direction, where an upwards portion of the first flashing member and a downwards portion of the second flashing members are interconnected in sliding engagement allowing the relative position between the first and second flashing members to be adjusted during mounting of the flashing device, where the first flashing member further comprises a outward portion extending at an angle in relation to the upwards portion and being configured for extending over the roof structure away from the roof window, where the second flashing member further comprises an inward portion extending at an angle in relation to the downward portion and being configured for engagement with the frame of the roof window, and where each sealing member includes a first sealing portion and a second sealing portion, said first sealing portion being positioned substantially in parallel with the inward portion and said second sealing portion being positioned substantially in parallel with the downward portion, characterized in that the sealing member further comprises at least one frame attachment portion configured for attachment of the sealing member to the frame of the roof window, where the at least one frame attachment portion comprises a flange extending from the first sealing portion and being configured for sliding engagement with a groove in the frame and where the flange comprises a first flange leg extending from the first sealing portion away from the second sealing portion and a second flange leg extending from and substantially perpendicular to the first flange leg and substantially in parallel with the first sealing portion such that a space is formed between a lower surface of the second flange leg and the first sealing portion.

2. The flashing device according to claim 1, where the at least one frame attachment portion comprises a fastener guiding section configured for guiding a fastener used for securing the sealing member to the frame.

3. The flashing device according to claim 2, where the fastener guiding section extends substantially in parallel with the first sealing portion and substantially perpendicular to the second sealing portion.

4. The flashing device according to claim 2, where the fastener guiding section extends from an opening in the second sealing portion and through the first sealing portion.

5. The flashing device according to claim 2, where the second flashing member comprises a hole positioned in continuation of the fastener guiding section such that a fastener guided by the fastener guiding section projects through said hole.

6. A method of mounting a flashing device at a roof window comprising a frame and mounted in a roof structure, comprising the following steps:

A) providing a flashing device comprising a first flashing member and a second flashing member both extending in a length direction of the flashing device, and two sealing members arranged at opposite ends of the flashing device seen in the length direction, where an upwards portion of the first flashing member and a downwards portion of the second flashing members are interconnected in sliding engagement allowing the relative position between the first and second flashing members to be adjusted during mounting of the flashing device, where the first flashing member further comprises a outward portion extending at an angle in relation to the upwards portion and being configured for extending over the roof structure away from the roof window, where the second flashing member further comprises an inward portion extending at an angle in relation to the downward portion and being configured for engagement with the frame of the roof window, and where each sealing member includes a first sealing portion and a second sealing portion, said first sealing portion being positioned substantially in parallel with the inward portion and said second sealing portion being positioned substantially in parallel with the downward portion, characterized in that the sealing member further comprises at least one frame attachment portion configured for attachment of the sealing member to the frame of the roof window, where the at least one frame attachment portion comprises a flange extending from the first sealing portion and being configured for sliding engagement with a groove in the frame and where the flange comprises a first flange leg extending from the first sealing portion away from the second sealing portion and a second flange leg extending substantially perpendicular to the first flange leg and substantially in parallel with the first sealing portion, B) arranging the flashing device on the roof structure and at an outer side of the frame of the roof window facing away from a frame opening defined by the frame, C) connecting the sealing member to the frame using the at least one frame attachment portion.

7. The method according to claim 6, where, during step B), the flashing device is brought into engagement with the outer side of the frame by displacing the flashing device in a direction substantially perpendicular to the upwards and downwards portions.

8. The method according to claim 6, where, during step C), the flange extending from the first sealing portion of the frame attachment portion is brought into engagement with the groove in the frame by a sliding movement.

9. The method according to claim 8, where the flange is brought into engagement with a groove in an interface unit of the frame.

10. The method according to claim 6, where, during step C), a fastener is inserted in a fastener guiding section of the frame attachment portion and into the frame.

11. The method according to claim 10, where the fastener is inserted through a hole in the second flashing member.

12. The flashing device according to claim 3, where the fastener guiding section extends from an opening in the second sealing portion and through the first sealing portion.

13. The flashing device according to claim 3, where the second flashing member comprises a hole positioned in continuation of the fastener guiding section such that a fastener guided by the fastener guiding section projects through said hole.

14. The flashing device according to claim 4, where the second flashing member comprises a hole positioned in continuation of the fastener guiding section such that a fastener guided by the fastener guiding section projects through said hole.

15. The method according to claim 7, where, during step C), the flange extending from the first sealing portion of the frame attachment portion is brought into engagement with the groove in the frame by a sliding movement.

16. The method according to claim 7, where, during step C), a fastener is inserted in a fastener guiding section of the frame attachment portion and into the frame.

17. The method according to claim 8, where, during step C), a fastener is inserted in a fastener guiding section of the frame attachment portion and into the frame.

18. The method according to claim 9, where, during step C), a fastener is inserted in a fastener guiding section of the frame attachment portion and into the frame.

* * * * *